US012312201B2

(12) United States Patent
Küttel et al.

(10) Patent No.: US 12,312,201 B2
(45) Date of Patent: May 27, 2025

(54) SLOT DRUM FOR A WINDING MACHINE AND WINDING MACHINE

(71) Applicant: SSM Schärer Schweiter Mettler AG, Wädenswil (CH)

(72) Inventors: Martin Küttel, Gattikon ZH (CH); André Wandeler, Samstagern (CH)

(73) Assignee: SSM Schärer Schweiter Mettler AG, Wädenswil (CH)

( * ) Notice: Subject to any disclaimer, the term of this patent is extended or adjusted under 35 U.S.C. 154(b) by 211 days.

(21) Appl. No.: 18/166,112

(22) Filed: Feb. 8, 2023

(65) Prior Publication Data

US 2023/0249939 A1 Aug. 10, 2023

(51) Int. Cl.
*B65H 54/50* (2006.01)
*B65H 54/48* (2006.01)

(52) U.S. Cl.
CPC ..... *B65H 54/50* (2013.01); *B65H 2701/31* (2013.01)

(58) Field of Classification Search
CPC .... B65H 54/50; B65H 54/48; B65H 54/2842; B65H 54/702; B65H 54/28; B65H 54/02; B65H 57/04; B65H 57/28; D01H 11/00; D01H 13/06
See application file for complete search history.

(56) References Cited

U.S. PATENT DOCUMENTS 2,815,904 A * 12/1957 Lepome ..... B65H 54/50 242/482.2
3,004,726 A * 10/1961 Kuppers ..... B65H 54/2842 242/482.3
3,532,279 A 10/1970 Toussaint

FOREIGN PATENT DOCUMENTS

| | | | | |
|---|---|---|---|---|
| CH | 507147 | A | 5/1971 | |
| CN | 209 427 865 | U | 9/2019 | |
| CN | 209337866 | U | 9/2019 | |
| CN | 209 635 606 | U | 11/2019 | |
| EP | 2 170 750 | A1 | 4/2010 | |
| FR | 1012832 | A * | 7/1952 | ..... B65H 54/50 |
| GB | 727027 | | 6/1955 | |
| GB | 814293 | A | 6/1959 | |
| JP | 2003112852 | A | 4/2003 | |
| WO | WO2008154949 | A1 | 12/2008 | |

OTHER PUBLICATIONS

Swiss Patent Office Search Report, May 3, 2022.

* cited by examiner

*Primary Examiner* — Sang K Kim
*Assistant Examiner* — Katelynne R Burrell
(74) *Attorney, Agent, or Firm* — Dority & Manning, P.A.

(57) ABSTRACT

A slot drum for a winding machine for traversing a yarn has a drum body including a first half and an adjacent second half, the drum body held in a rotationally fixed manner on a drum shaft. The adjacent first and second halves defining a yarn guide slot that extends around the drum body. The first and second halves include a side shield, a cylindrical jacket, and a hub for mounting on the drum shaft. The first half is displaceable on the drum shaft in a direction of the drum axis via an actuator. The first half rotates relative to the second half as the first half moves in the direction of the drum axis.

11 Claims, 4 Drawing Sheets

SLOT DRUM FOR A WINDING MACHINE AND WINDING MACHINE

FIELD OF THE INVENTION

The present invention relates to a slot drum for a winding machine for traversing a yarn with a drum body consisting of a first half and a second half, and with a drum shaft with a drum axis, wherein the drum body is held in a rotationally fixed manner on the drum shaft and has a yarn guide slot which extends around the drum body and is formed by the adjacent halves of the drum body. Each half of the drum body is formed from a side shield and a cylindrical jacket and a hub for mounting on the drum shaft.

BACKGROUND

Such slot drums are used in winding machines for traversing a yarn during the production of sewing yarn spools. During winding, the yarn is moved back and forth with a traversing along a longitudinal axis of a sewing yarn spool tube, whereby various types of windings in terms of structure and shape are formed. The sewing yarn spool tube is driven directly via a motor, which sets at least one sewing yarn tube receptacle or one spool mandrel into rotation, or indirectly via a distributor roller arranged parallel to the sewing yarn spool tube. The distributor roller simultaneously serves as a support roller. The distributor roller can simultaneously be designed as a slot drum. Due to the nature and properties of the sewing yarn, no additional yarn guide is necessary and the yarn is guided directly by the yarn guide slot in the slot drum and by a rotation of the slot drum in such a way that the yarn is moved back and forth. The yarn is clamped between the slot drum and the sewing yarn spool tube, or the yarn already on the sewing yarn spool tube, and is thereby deposited on the sewing yarn spool tube.

When a winding process is started anew, the yarn must be inserted manually into the yarn guide slot of the slot drum, which requires a particular skill of the operator. If the color of the yarn is also changed from one winding process to the next, a cleaning of the yarn guide slot or also of the drum body is necessary under certain circumstances in order to avoid transfer of ink onto the yarn to be newly wound or dirt entry into the sewing yarn spool. Depending on the properties of the yarn, a fine abrasion of the yarn during traversing can result in a discoloration of the yarn guide slot, or the rubbed-off parts can accumulate in the interior of the drum body.

Generic winding machines with slot drums are known from the prior art; for example, CN 209 635 606 U discloses a slot drum which is formed from four shells which form the guide slot and are held on two side shields. The side shields in turn are held in a rotationally fixed manner on a shaft. By disassembling the components forming the yarn guide slot, the structure enables a cleaning or replacement of the elements forming the yarn guide slot. EP 2 170 750 A1 furthermore discloses a slot drum with one-sided mounting of the drum shaft so that the slot drum can be disassembled from the drum shaft toward one side. CN 209 427 865 U discloses a slot drum in a lightweight design for the purpose of reducing the dead weight in order to achieve energy-saving operation at high rotational speeds in comparison to steel structures.

The known embodiments of the slot drums are disadvantageous in that cleaning is complicated and requires disassembly of the slot drum or at least parts thereof. In addition, even during a threading process, complicated movements of the yarn are required due to a small width of the yarn guide slot.

Further winding machines with slot drums are known from documents JP2003112852A, GB814293A, U.S. Pat. No. 3,532,279A and CH507147A.

SUMMARY OF THE INVENTION

An object of the present invention is therefore to propose a device for traversing a yarn, which device enables simple cleaning and threading, without having to forgo a high quality and uniformity of the spools. Additional objects and advantages of the invention will be set forth in part in the following description, or may be obvious from the description, or may be learned through practice of the invention.

The objects are achieved by a slot drum for a winding machine for traversing a yarn with a drum body consisting of a first half and a second half, and with a drum shaft with a drum axis, wherein the drum body is held in a rotationally fixed manner on the drum shaft and has a yarn guide slot which extends around the drum body and is formed by the adjacent halves of the drum body. Each of the two halves is formed from a side shield and a cylindrical jacket and a hub for mounting on the drum shaft.

At least the first half of the drum body is held displaceably on the drum shaft in the direction of the drum axis, and an actuator for moving the at least first half of the drum body on the drum shaft in the direction of the drum axis is provided. In addition to the movement of the at least first half of the drum body in the direction of the drum axis, a simultaneous rotation of the at least first half relative to the second half about the drum axis is provided.

Since the yarn guide slot is guided at an angle to the drum axis across the jacket of the drum body, a rotation of the first half of the drum body about the drum axis in addition to the linear movement results in a larger opening of the width of the yarn guide slot during an even minor linear displacement. As a result, the linear movement in the direction of the drum axis and also the actuator can be designed for a smaller displacement.

As a result, sufficiently large openings of the width of the yarn guide slot can be achieved even in the case of relatively narrow winding stations, or the opening of the yarn guide slots that is characteristic of the present invention does not lead to a supercritical widening of the winding stations. Movements in the direction of the winding axis can likewise be minimized in this way and possible interferences with adjacent winding stations (which may be in winding mode) due to vibrations are thus minimized.

The rotation can be generated by a corresponding arrangement of the actuator for the linear movement or a corresponding structure of the first hub of the drum body. For example, for moving the first half, the actuator can engage in the first hub via a pin in such a way that by means of a guide groove created in the first hub, the pin and thus the first half of the drum body simultaneously carry out an axial and a rotating movement, wherein the actuator is moved only in a linear axial direction. In an alternative embodiment, the rotation is provided by a drive independent of the actuator. In this way, the linear movement and the rotation can be adjusted and performed independently of one another so that the most favorable movement for the necessary work can take place.

Each of the two halves of the drum body is, for example, manufactured during its construction from a side shield and a cylindrically shaped jacket detachably fastened to the side shield. The respective side shield is held in a rotationally fixed manner on the drum shaft by a hub formed on the side shield. In an alternative structure, the cylindrical jacket, the side shield and the hub are manufactured in one piece. An edge, facing away from the side shield in each case, of the cylindrical jacket is in each case provided in terms of its shape according to the yarn guide slot. When the two halves are constructed on the drum shaft, the edges, facing away from the respective side shield, of the jackets are opposite and are spaced apart from one another in such a way that the yarn guide slot forms between the cylindrical jackets. Yarn guide slots generally have a width of 0.2 mm to 2.0 mm depending on the yarn to be processed. The two halves of the drum body are accordingly attached to the drum shaft at a distance corresponding to the width of the yarn guide slot and are connected to the drum shaft in a rotationally fixed manner.

The fastening on the drum shaft, the side shield, and the jacket can be manufactured and screwed in individual parts or, alternatively, can be provided in a one-piece design. Advantageously, the jacket is detachably connected to the side shield so that a simple replacement of the jacket, for example in the case of a necessary change in the slot shape, is possible. The jacket is also subject to wear by the yarn sliding over its surface and is to be replaced after a certain operating time. The drum shaft and thus the drum body are set into rotation via a drive. By the rotation of the drum shaft and thus of the drum body, a reciprocating movement of the yarn guided in the yarn guide slot is achieved due to the arrangement of the yarn guide slot.

According to the invention, at least the first half of the drum body is attached to the drum shaft in such a way that it can be displaced in the direction of the drum axis. For the movement in the direction of the drum axis, the first half of the drum body is connected to an actuator. The actuator can be connected to the first side shield or to the first hub arranged between the first side shield and the drum shaft for mounting the first side shield on the drum shaft.

Before threading a yarn into the yarn guide slot or when a cleaning of the drum body is about to happen, the actuator can displace the first half of the drum body on the drum axis in such a way that the two halves move apart and the yarn guide slot increases in width. In a development, the enlargement of the yarn guide slot can take place in two steps. In a first step, the enlargement of the width of the yarn guide slot is selected such that the threading is simplified and can be carried out with one hand or by a robot. In a second step, the two halves are moved so far apart that there is good accessibility for the maintenance and cleaning of the drum body.

In an alternative embodiment, the drum shaft has a guide groove, and a guide pin, which engages in the guide groove, is provided on the first hub. By means of this design, the linear movement in the direction of the drum axis and the rotation of the first half of the drum body can be provided by a single actuator. In this case, the guide groove can be provided directly in the drum shaft or can be arranged in a hollow shaft attached over the drum shaft. When the actuator operatively connected to the first hub is actuated, the first hub is displaced in the direction of the drum axis and is rotated by the action of the guide pin in the guide groove as a function of the rotation of the guide groove about the drum axis. In order to enable the width of the yarn guide slot to be adjusted, the guide groove can have a corresponding first part pointing in the direction of the drum axis.

Preferably, the first hub is connected to the actuator. By connecting the actuator to the first hub, the movement of the first half of the drum body is converted by the actuator into a relative movement between the first hub and the drum shaft, or between the first hub and the hollow shaft if the hollow shaft is present.

A pneumatic cylinder or an electric drive is preferably provided as an actuator. Due to the small displacement paths, the electric drive can be designed as a simple electromagnetic linear drive. Alternatively, however, the use of a favorable stepper motor in combination with a toothed rack for converting the rotational movement of the motor into a linear movement is also possible. An embodiment is also possible in which the actuator is designed as a manually actuatable lever. In this case, opening of the drum body is possible by a simple manual intervention by the operator and can also be performed independently of an energy supply.

Advantageously, the actuator is connected to the first hub via a driver, wherein the driver is rotatably held on the first hub. This makes it possible to maintain the connection between the first hub, or driver, and the actuator even during a winding mode. For example, a ring that is partially enclosed by a fork-shaped connecting part of the actuator and held by a bearing on the first hub may be provided. With such a structure, a simple rotational movement of the first hub and thus of the first half of the drum body during a linear movement of the driver is also possible. Further design possibilities result from designing the driver as a fork or eyelet.

Preferably, a coupling connection is provided between the drum shaft and the at least first half of the drum body. As a result, after the coupling has been opened, a movement of the first half of the drum body can be carried out independently of the drum shaft. This is in particular advantageous when carrying out a rotating movement of the first half, since the latter can be carried out when the drum shaft is stationary.

It is advantageous if the coupling connection is located between the first hub of the first half of the drum body and the drum shaft. The first half of the drum body is mounted in a stationary manner on the first hub, through which the drum shaft is guided. As a result, the first half of the drum body can be moved together with the first hub on the drum shaft. If a coupling is provided between the first hub and the drum shaft, a rotation of the first hub about the drum axis independently of the drum shaft is possible only after the connection is released. Such a coupling can be a disengaging design, in which a mechanical decoupling of the first hub from the drum shaft can take place. Alternatively, however, a non-disengaging coupling is also possible, in which, for example, an elevation, for example a pin, is attached to the drum shaft and engages in a corresponding depression in the first hub. Such a design has the effect that, during a linear movement of the first hub in the direction of the drum axis, the coupling is automatically released and separate disengagement of the coupling can be dispensed with. In such a case, only the axial position of the first hub is to be locked for wind-up operation.

Preferably, a rotation of the drum shaft or of the drum body about the drum axis is locked when the halves of the drum body are moved apart. Such a locking can take place mechanically or electronically. In the case of a mechanical locking, the latter can be coupled to the same actuator by which the movement of one half of the drum body is carried out.

Preferably, the movement of the at least first half of the drum body provides for the formation of a distance of at least 10 mm between the two halves of the drum body. An opening of 10 mm is sufficient to make a threading process easier. A movement of at least 20 mm is particularly preferably provided. When a distance of 20 mm or more is formed, threading of the yarn with only one hand is easily possible. Simple manual cleaning can also be carried out with this opening. Furthermore, it is advantageous if the rotation of the at least first half about the drum axis during the opening of the drum body is provided in a range of 5 to 40 angular degrees. With an opening in the direction of the drum axis and an additional rotation of the two drum halves relative to one another, a short axial movement can create optimal access. Due to the small axial displacement of one half, a compact structure of the device necessary for movement can be achieved. A distance of 50 mm and a rotation by 30 angular degrees have been found to be particularly preferable movement variables. As a result, such a large opening of the two halves can be achieved that a simple manual cleaning of the slot drum is possible. A sufficiently large opening is thus also achieved independently of the shape of the slot drum, or of the yarn guide slot. When the two halves are replaced, the device for opening the slot drum therefore does not have to be replaced or changed due to a change in the winding characteristic as a result of a different course of the yarn guide slot.

Furthermore, a winding machine with at least one slot drum according to the preceding description is proposed, wherein the winding machine has a protective cover of the slot drum and provision is made that the halves of the slot drum automatically move apart when the protective cover is opened. The advantageous automatic system may be mechanical or electrical. For example, the position of the protective cover can be reported to the controller by a corresponding sensor. As soon as this sensor detects an opening of the protective cover, the halves of the drum body are moved apart. As soon as the protective cover leaves the open position again, the halves of the drum body are moved together again. Alternatively, a mechanical automatic system would mean that by opening the door, the halves of the drum body are moved apart via a corresponding device. Within the meaning of the invention, the protective cover in this case represents the actuator which moves the first half of the drum body. For example, the protective cover can be connected to the hub via a lever. The opening of the protective cover itself can also be provided mechanically by an operator or automatically by means of a corresponding pneumatic, electrical or electropneumatic drive.

BRIEF DESCRIPTION OF THE DRAWINGS

Further advantages of the invention are described in the following exemplary embodiment. In the figures.

DETAILED DESCRIPTION

Figure 1:
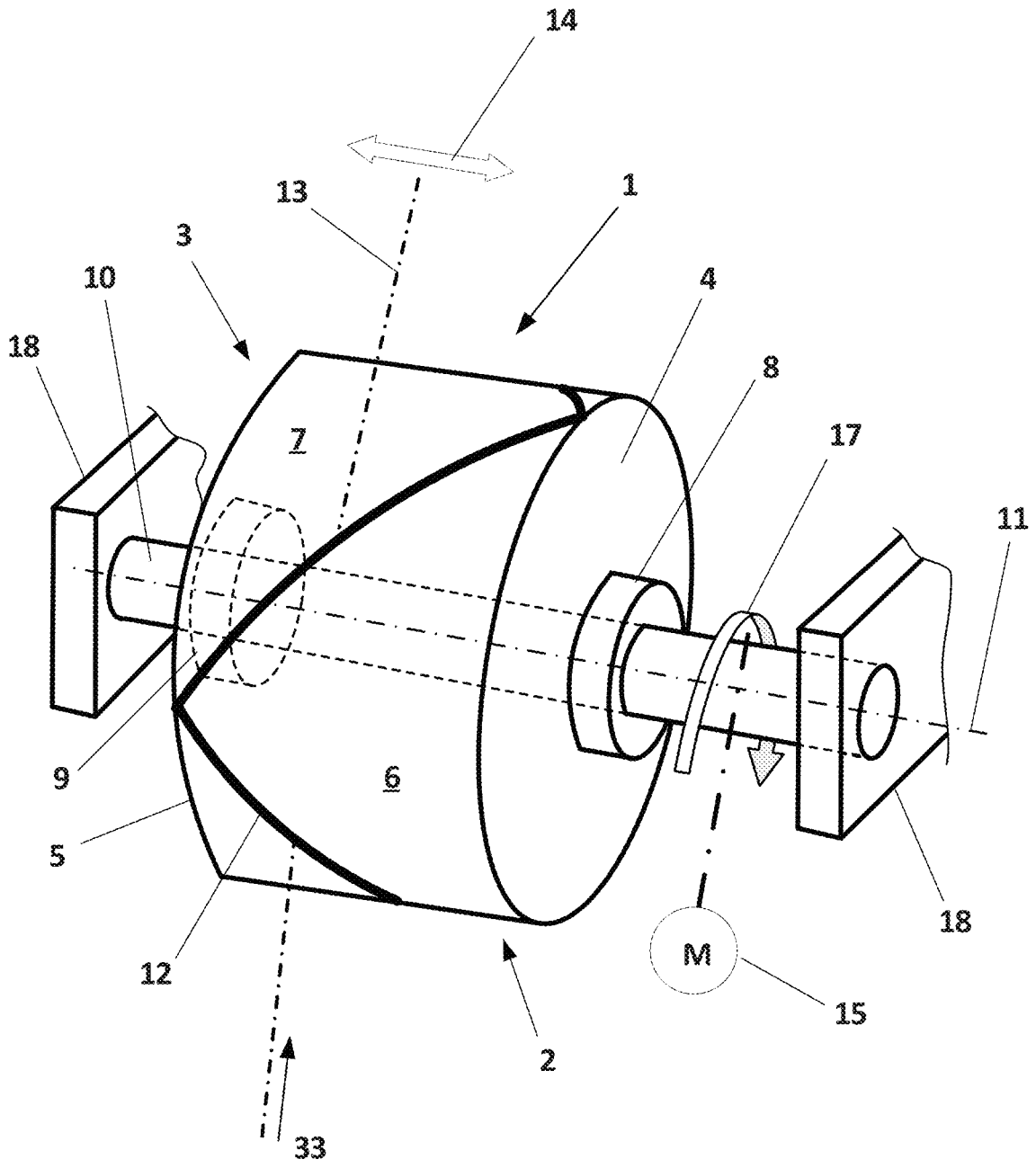
Fig. 1 Prior Art
FIG. 1 shows a schematic view of a slot drum according to the prior art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic top view of an embodiment of a slot drum according to the prior art. The slot drum consists of a drum body 1, which is composed of a first half 2 and a second half 3. The first half 2 has a first side shield 4 and a first jacket 6 and a first hub 8. The first side shield 4 is connected to the first hub 8 and the first jacket 6, wherein a one-piece design may also be provided; in particular, the first hub 8 and the first side shield 4 may be provided as a one-piece component. The second side shield 5 is connected to the second hub 9 and the second jacket 7, wherein a one-piece structure may also be provided in the case of the second half 3. The respective halves 2 and 3 are held in a rotationally fixed manner with their hubs 8 and 9 on a drum shaft 10 with a drum axis 11. The drum shaft 10 is rotatably held in a machine frame 18. A schematically illustrated drive 15 sets the drum shaft 10 into a rotation 17 about the drum axis 11. The adjacent edges of the first jacket 6 and of the second jacket 7 are spaced apart from one another in such a way that a yarn guide slot 12 forms between the edges. A yarn 13 is guided through the yarn guide slot 12 in such a way that a reciprocating movement 14 for the yarn 13 results during a rotation 17 of the drum body 1 about the drum axis 11. The yarn 13 impinging on the yarn guide slot 12 in the yarn conveying direction 33 is deflected by the rotation 17 of the drum body 1 and the course of the yarn guide slot 12 in the direction of the drum axis 11.

Figure 2A:
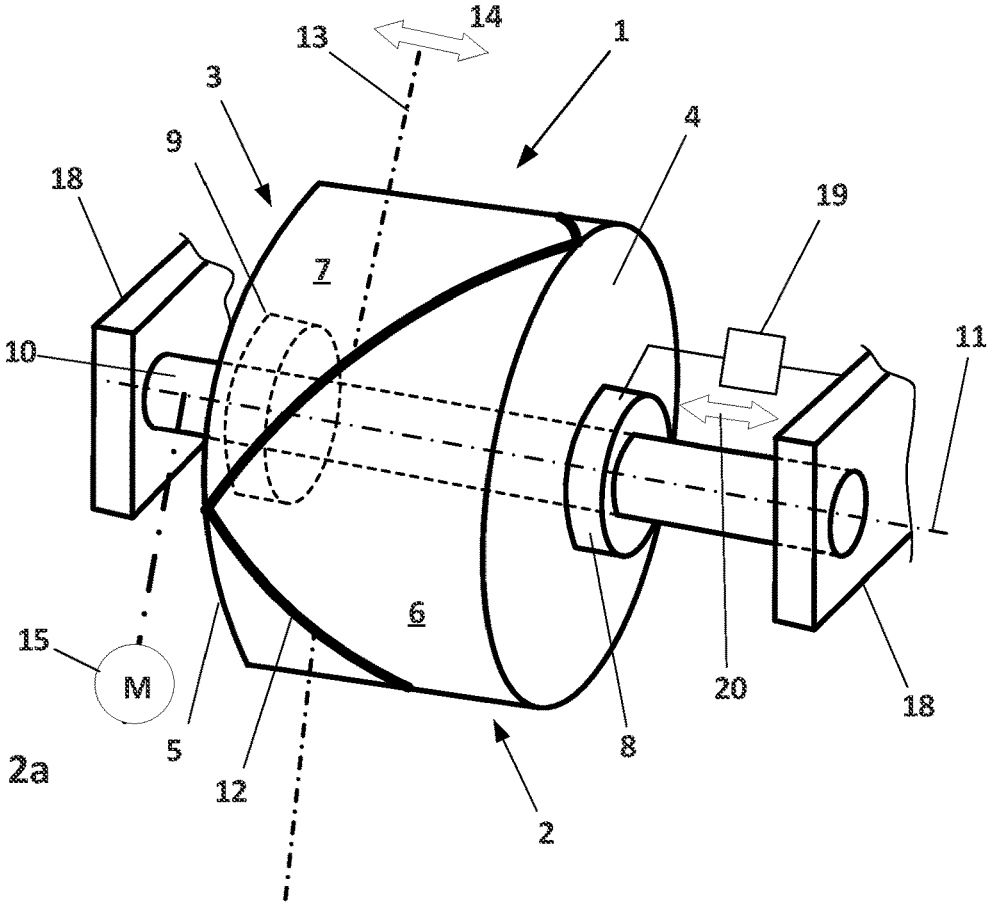
FIG. 2*a* shows a schematic view of a first embodiment of a slot drum according to the invention in the closed state.

FIG. 2*a* shows a schematic view of a first embodiment of a slot drum according to the invention in the closed state. The closed state is to be understood as the position of the first half 2 and of the second half 3 of the drum body 1 that results in a yarn guide slot 12 between the halves 2 and 3 and enables a reciprocating movement 14 of the yarn 13 during a rotation of the drum body 1. The slot drum 1 shown comprises a first half 2 and a second half 3, each of the halves 2 and 3 respectively having a side shield 4 and 5, respectively, a hub 8 and 9, respectively, and a jacket 6 and 7, respectively. The yarn guide slot 12 through which the yarn 13 is guided is formed by the adjacent edges of the first jacket 2 and of the second jacket 3. The drum body 1 is held in a rotationally fixed manner on the drum shaft 10, and the drum shaft 10 is mounted rotatably in the machine frame 18. By means of a drive 15, the drum shaft 10 is set into rotation about the drum axis 11 and the reciprocating movement 14 for the yarn 13 is thus triggered. The hub 8 of the first half 2 of the drum body 1 is connected to an actuator 19. By means of the actuator 19, the first half 2 of the drum body 1 is set into a linear movement 20 in the direction of the drum axis 11. This results in a change in the distance between the first half 2 and the second half 3 of the drum body 1.

Figure 2B:
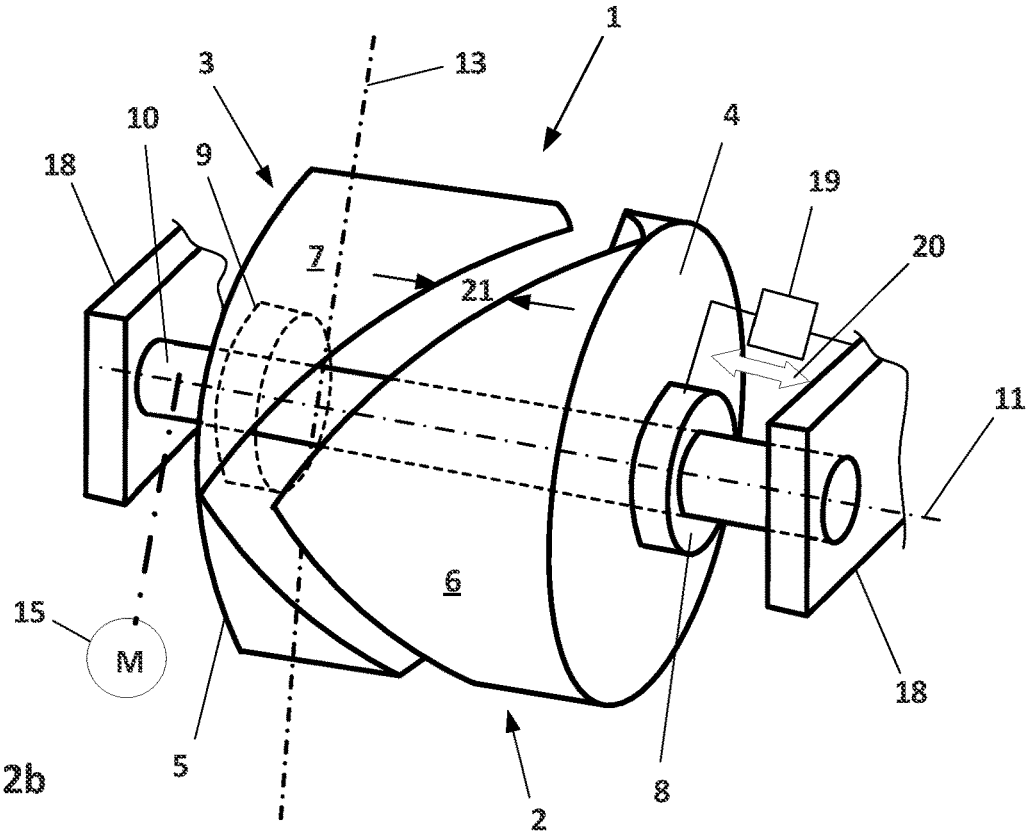
FIG. 2*b* shows a schematic view of a first embodiment of a slot drum according to the invention in the open state.

Accordingly, FIG. 2*b* subsequently shows the slot drum according to FIG. 2*a* in the open state. The slot drum 1 shown comprises a first half 2 and a second half 3, each of the halves 2 and 3 respectively having a side shield 4 and 5, respectively, a hub 8 and 9, respectively, and a jacket 6 and 7, respectively. By means of the actuator 19, the first half 2 of the drum body 1 has been moved so far away from the second half 3 of the drum body 1 in the direction of the drum axis 11 that a distance 21 is established. As a result of the distance 21 between the first jacket 6 and the second jacket 7, the edges, forming the yarn guide slot 12 (see FIG. 2*a*) in the closed state, of the jackets 6 and 7 can be cleaned. Simple threading of the yarn 13 between the two drum halves 2 and 3 is also possible. The distance 21 is determined by the linear movement 20 of the actuator 19. Accordingly, the drum body 1 can be opened at a predetermined distance 21 and can also be closed up to a specific yarn guide slot 12 (see FIG. 2*a*) adapted to the respective yarn.

Figure 3:
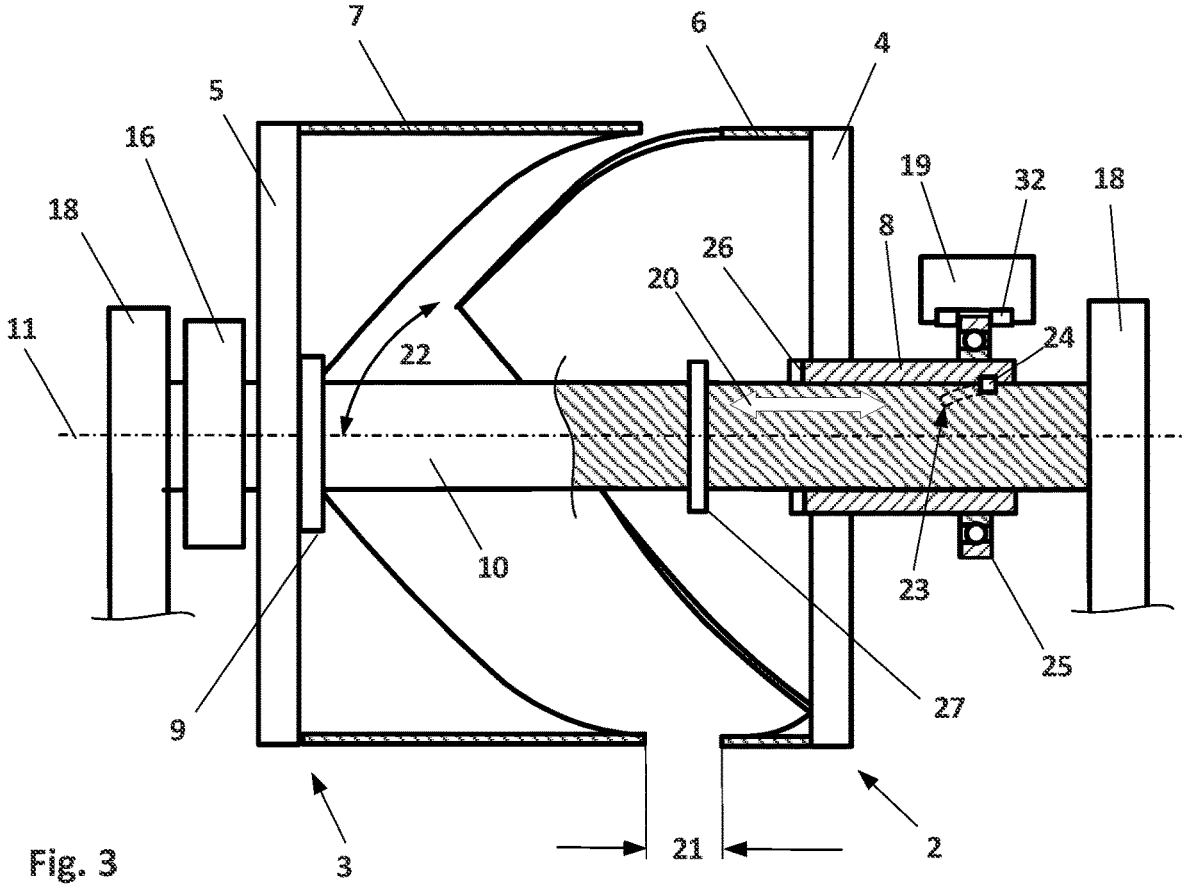
FIG. 3 shows a schematic representation of a longitudinal section of a second embodiment of a slot drum according to the invention in the open state.

FIG. 3 shows a schematic representation of a longitudinal section of a second embodiment of a slot drum according to the invention in the open state. The drum shaft 10 is held rotatably about the drum axis 11 in the machine frame 18. A drive wheel 16 is provided on the drum shaft 10. By means of a drive (not shown), the drum shaft 10 can be set into rotation via the drive wheel 16. The drive wheel 16 can be designed as a chain wheel, belt pulley or toothed wheel depending on the design of the drive. The second half 3 consists of a second side shield 5, a second jacket 7, and a second hub 9 and is connected to the drum shaft in a rotationally fixed and stationary manner by the second hub 9. The first half 2 has a first side shield 4, a first jacket 6 and a first hub 8. In contrast to the second half 3, the first hub 8 is held by the drum shaft 10 but is not connected thereto in a stationary manner or in a rotationally fixed manner.

A pin 27 which is arranged transversely to the drum axis 11 and penetrates through the drum shaft 10 is provided in the drum shaft 10, said pin serving as a coupling half for a rotationally fixed connection between the first half 2 and the drum shaft 10. A depression 26 is formed as a counterpart on the first hub 8. If the first half 2 is displaced by the actuator 19 in the direction of the drum axis 11 toward the second half 3 on the drum shaft 10, the pin 27 engages in the depression 26 and a rotationally fixed connection is established between the drum shaft 10 and the first hub 8 and thus the first half 2. The interaction of pin 27 and depression 26 creates a coupling connection between the drum shaft 10 and the first half 2 of the drum body 1. A driver 25 is held in a rotatable and stationary manner on the first hub 8. The driver 25 is partially enclosed by a fork 32. The fork 32 is fastened to the actuator 19 or is moved by the actuator 19 in the direction of the drum axis 11. As a result of this movement of the fork 32, the first hub 8 on the drum shaft 10 is pushed back and forth in the direction of the drum axis 11 with the linear movement 20, resulting in a distance 21 between the first half 2 and the second half 3.

In addition, a guide groove 23 is provided in the drum shaft 10, wherein the guide groove 23 is created with a slope in the direction of the drum axis 11. A guide pin 24 directed toward the drum shaft 10 is attached to the first hub 8. The guide pin 24 engages in the guide groove 23. This has the effect that, as a result of the guide pin 24, when a linear movement 20 is carried out, the hub 8 follows the course of the guide groove 23 and, in addition to the linear movement 20, experiences a rotation 22 about the drum axis 11 in the direction of the drum axis 11. Due to the course of the yarn guide slot, or of the separating line between the first half 2 and the second half 3, the additional rotation 22 of the two halves 2 and 3 relative to one another during a linear movement 20 by the distance 21 results in a significantly larger opening than in the case of a linear movement 20 without rotation 22.

Figure 4:
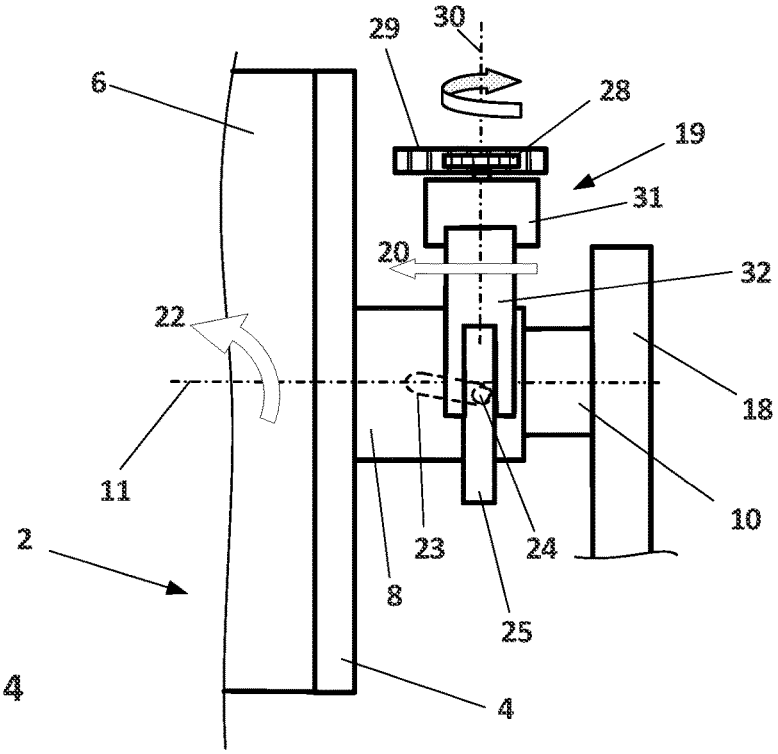
FIG. 4 shows a schematic representation of an embodiment of an actuator for opening the slot drum.

FIG. 4 shows a schematic representation of an embodiment of an actuator for opening the slot drum as it is used, for example, in an embodiment according to FIG. 3. FIG. 4 shows the first half 2 with the first jacket 6, the first side shield 4 and the first hub 8. The first half 2 is held on the drum shaft 10 by the first hub 8. The drum shaft 10 is held rotatably about its drum axis 11 in the machine frame 18. A driver 25 is rotatably mounted on the first hub 8. A fork 32, which in turn is fastened to an electric drive 31, partially engages via the driver 25. The actuator 19 illustrated in the embodiment shown consists of the fork 32, the electric drive 31 and a toothed wheel 28. The toothed wheel 28 is fastened to the electric drive 31 and is driven by the latter. Furthermore, a toothed rack 29 is provided, which is fastened to the machine frame 18 in a stationary manner. When the electric drive 31 is started up, the toothed wheel 28 rotates, for example, in a direction of rotation, indicated by the arrow, about an actuator axis 30. As a result of the toothed wheel 28 engaging in the toothed rack 29, the actuator 19, in the embodiment shown, the electric drive 31, the fork 32 and the toothed wheel 29 are moved away from the machine frame 18 by a linear movement 20 in the direction of the drum axis 11. The actuator axis 30 is displaced on the drum shaft 10 in the direction of the drum axis 11. As a result of the fork 32, during this displacement, the driver 25 and thus also the first half 2 are moved by the actuator 19 in the direction of the drum axis 11.

A guide groove 23 in which a guide pin 24 engages is additionally provided in a surface of the drum shaft 10. The guide pin 24 is connected to the first hub 8. In the case of a linear movement 20 by the first hub 8, the first hub 8 is moved in a rotation 22 about the drum axis 11 as a result of the guide pin 24 extending in the guide groove 23. Since the driver 25 is rotatably mounted on the first hub 8, the rotation 22 of the first hub 8 has no influence on the movement of the actuator 19, which carries out a mere linear movement 20.

Figure 5:
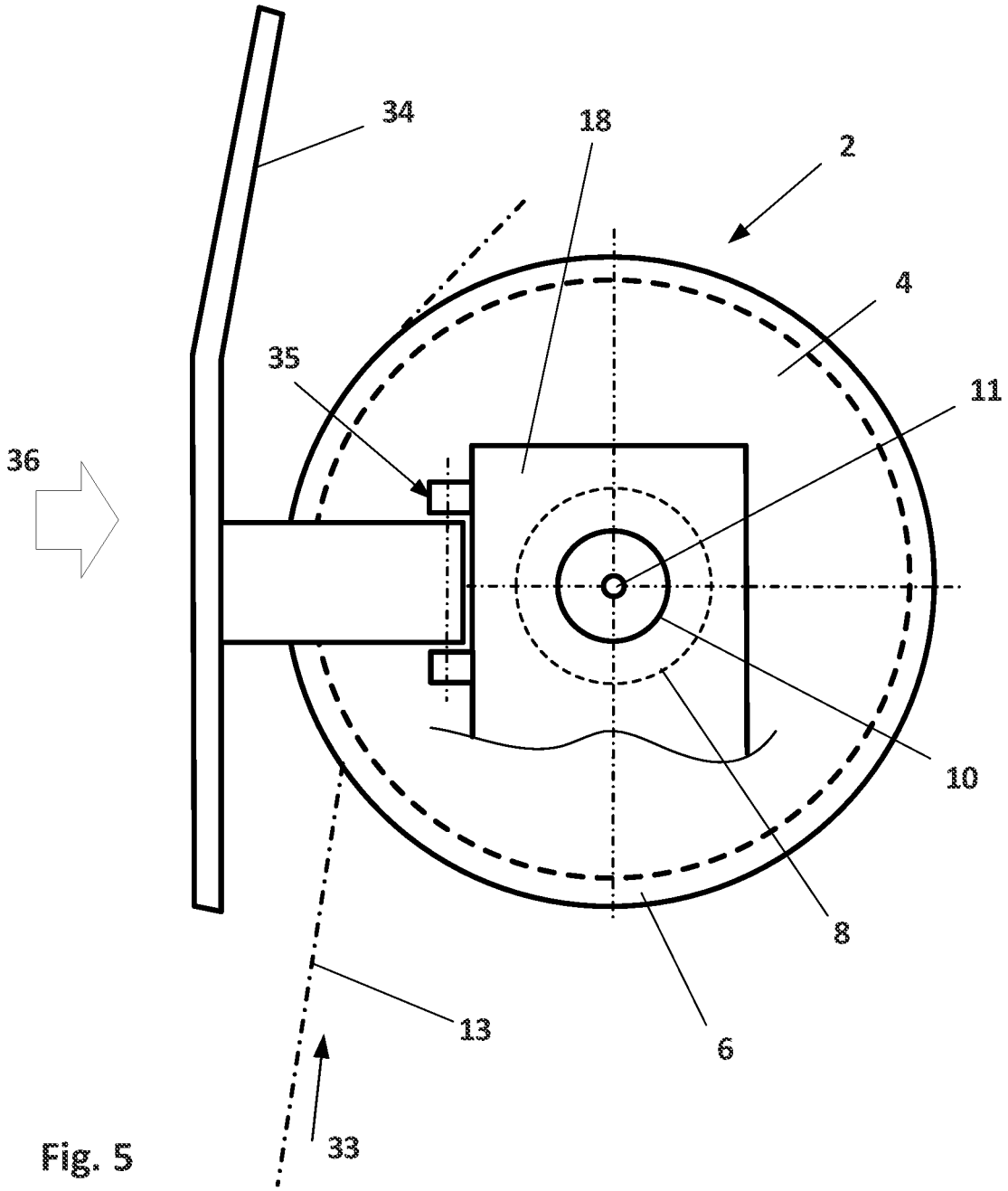
FIG. 5 shows a schematic representation of a side view of a slot drum according to the invention.

FIG. 5 shows a schematic representation of a side view of a slot drum, wherein the yarn 13 with its yarn conveying direction 33 is shown for a better understanding of the side view. The first half 2 of the drum body is shown, said half being formed from the first side shield 4 and the first jacket 6 and the first hub 8. The first half 2 is held on the drum shaft 10. The drum shaft 10 is mounted rotatably in the drum axis 11 in the machine frame 18. The drum shaft 10 is set into a rotation 17 by a drive (not shown) and subsequently rotates at a high rotational speed. In order to exclude a hazard to the operating personnel, a protective cover 34 is arranged in front of the operating side 36. The protective cover 34 is held on the machine frame 18 via a hinge 35. By simply monitoring the position of the protective cover 34, a controller (not shown) could trigger or correspondingly lock various functions. For example, operation of the slot drum with an open protective cover 34 can be locked, or a linear movement of the first half 2, as shown in FIGS. 2*a*, 2*b*, can be triggered.

The present invention is not limited to the shown and described exemplary embodiments. Modifications within the scope of the claims are possible, as well as a combination of the features, even if these are shown and described in different embodiments.

LIST OF REFERENCE SIGNS

1 Drum body
2 First half
3 Second half
4 First side shield
5 Second side shield
6 First jacket
7 Second jacket
8 First hub
9 Second hub
10 Drum shaft

11 Drum axis
12 Yarn guide slot
13 Yarn
14 Reciprocating movement
15 Drive of drum shaft
16 Drive wheel
17 Rotation of drum shaft
18 Machine frame
19 Actuator
20 Linear movement
21 Distance
22 Rotation
23 Guide groove
24 Guide pin
25 Driver
26 Depression
27 Pin
28 Toothed wheel
29 Toothed rack
30 Actuator axis
31 Electric drive
32 Fork
33 Yarn conveying direction
34 Protective cover
35 Hinge
36 Operating side

The invention claimed is:

1. A slot drum for a winding machine for traversing a yarn, comprising:

a drum body comprising a first half and an adjacent second half;

a drum shaft with a drum axis, wherein the drum body is held in a rotationally fixed manner on the drum shaft;

the adjacent first and second halves defining a yarn guide slot therebetween that extends around the drum body;

each of the first and second halves comprising a side shield, a cylindrical jacket, and a hub for mounting on the drum shaft;

the first half displaceable on the drum shaft in a direction of the drum axis;

an actuator configured with the first half to move the first half on the drum shaft; and wherein the first half rotates relative to the second half as the first half moves in the direction of the drum axis.

2. The slot drum according to claim 1, wherein the actuator is connected to the hub of the first half.

3. The slot drum according to claim 2, wherein the actuator comprises a pneumatic cylinder or an electric drive.

4. The slot drum according to claim 2, wherein the actuator is connected to the hub of the first half via a driver that is rotatably held on the hub of the first half.

5. The slot drum according to claim 1, further comprising a coupling connection between the drum shaft and the first half.

6. The slot drum according to claim 5, wherein the coupling connection is arranged between the drum shaft and the hub of the first half.

7. The slot drum according to claim 1, comprising a rotary drive configured with the first half and independent of the actuator, the rotary drive configured to rotate the first half as the first half moves in the direction of the drum axis.

8. The slot drum according to claim 1, wherein the drum shaft comprises a guide groove defined therein, and the first hub comprising a guide pin that engages in the guide groove.

9. The slot drum according to claim 1, wherein rotation of the drum shaft or of the drum body about the drum axis is locked when the first half is moved away from the second half along the drum axis.

10. The slot drum according to claim 1, wherein movement of the first half along the drum axis provides a space of at least 10 mm between the first and second halves along the yarn guide slot.

11. A winding machine, comprising:

the slot drum according to claim 1; and a protective cover, wherein the first half automatically moves along the drum axis away from the second half when the protective cover is opened.

* * * * *